US006921003B2

(12) United States Patent
Yu

(10) Patent No.: US 6,921,003 B2
(45) Date of Patent: Jul. 26, 2005

(54) WATER BOTTLE CAP

(76) Inventor: Charles Y. Yu, 25603 Amberleaf Rd., Torrance, CA (US) 90505

( * ) Notice: Subject to any disclaimer, the term of this patent is extended or adjusted under 35 U.S.C. 154(b) by 0 days.

(21) Appl. No.: 10/670,290

(22) Filed: Sep. 26, 2003

(65) Prior Publication Data

US 2005/0067434 A1 Mar. 31, 2005

(51) Int. Cl.[7] ..... B67D 5/06

(52) U.S. Cl. ..... 222/185.1; 222/81; 222/83.5; 141/352; 141/354; 141/364

(58) Field of Search ..... 222/185.1, 81–83, 222/83.5, 181.1; 215/254, 303, 253; 141/351–354, 364

(56) References Cited

U.S. PATENT DOCUMENTS 2,213,465 A * 9/1940 Gay ..... 15/257.075
4,699,188 A * 10/1987 Baker et al. ..... 141/18
4,874,023 A * 10/1989 Ulm ..... 141/346
4,991,635 A * 2/1991 Ulm ..... 141/346
5,289,854 A * 3/1994 Baker et al. ..... 141/18
5,297,599 A * 3/1994 Bucheli ..... 141/329
5,370,270 A * 12/1994 Adams et al. ..... 222/88
5,647,416 A * 7/1997 Desrosiers et al. ..... 141/351
5,687,867 A * 11/1997 Lamoureux ..... 215/303
5,957,316 A * 9/1999 Hidding et al. ..... 215/265
6,123,122 A * 9/2000 Dushman ..... 141/348
6,193,113 B1 * 2/2001 Hidding ..... 222/325
6,308,849 B1 * 10/2001 Kim ..... 215/303
6,408,904 B1 * 6/2002 Dushman ..... 141/352

* cited by examiner

*Primary Examiner*—Frederick C. Nicolas
(74) *Attorney, Agent, or Firm*—Raymond Y. Chan; David and Raymond

(57) ABSTRACT

A water bottle cap includes a cap body including a sealing platform and a surrounding sealing wall extended from the sealing platform for sealedly enclosing around an opening of a water bottle, and a water dispensing arrangement including a guiding channel extended from the sealing platform of the cap body and defining a water passage, and a sealing member, which is integrally mounted at the guiding channel to sealedly close the water passage defining a breakable edge portion and a retaining edge portion. Therefore, when the water bottle is installed on the water dispenser, a spigot adapter of the water dispenser is plugged into the water passage to break the sealing member at the breakable edge portion thereof while the retaining edge portion of the sealing member is remained to attach to the guiding channel.

20 Claims, 4 Drawing Sheets

WATER BOTTLE CAP

BACKGROUND OF THE PRESENT INVENTION

1. Field of Invention

The present invention relates to a water bottle, and more particularly to a water bottle cap which substantially seals at the opening of the water bottle so as to prevent any dust and dirt entering into the water bottle before the use thereof.

2. Description of Related Arts

Water dispensing units have been common water supplying equipments at homes or offices for supplying clean drinking water. Generally, the water dispending unit comprises a water dispenser having a top open reservoir and a water bottle placed on the open reservoir in an inverted manner.

Accordingly, a water bottle cap is usually used to seal the opening of the water bottle to prevent leakage of water from the water bottle during transportation. In addition, the water bottle cap can also prevent any dirt and dust from entering into the water bottle to contaminate the clean drinking water therein during storage. However, such water bottle cap has several drawbacks.

In order to dispense the water from the water bottle to the water dispenser for usage, the water bottle cap must be broken to unseal the opening of the water bottle such that the water bottle cap cannot be reused to seal on the opening of the water bottle after emptying the water therein. It is worth to mention that the water bottle is arranged to repeatedly use to contain the drinking water such that the emptied water bottle will be contaminated when the opening of the emptied water bottle is left uncover. Since the water supplying company must clean the water bottle every time after the usage, the maintenance cost of the water bottle will be highly increased.

In addition, when the water bottle is lifted in an inverted manner to fill the water to the water dispenser, the water will always spill on the ground. Since most of the water dispensers require to electrically connect with the power supply, the water spilling out from the water bottle may cause serious circuit damage of the water dispenser.

An improved water bottle cap comprises a sealing layer mounted at the opening of the water bottle wherein the water dispenser comprises an elongated spigot adapter mounted at the open reservoir such that while changing the water bottle, the spigot adapter is arranged to penetrate through the sealing layer so as to prevent the water spilling out from the water bottle accidentally. Accordingly, the strength of the sealing layer must be strong enough to withstand an external force so as to prevent the sealing layer from being broken accidentally during transportation and storage. However, it is a conflict that the sealing layer should be capable of being penetrated by the spigot adapter during dispensing.

Furthermore, when the spigot adapter penetrates through the sealing layer, residual of the sealing layer may accidentally enter into the water bottle. Therefore, the residual of the sealing layer may either suck into the water dispenser during the water dispensing operation or leave inside the water bottle. As a result, the residual of the sealing layer causes the mechanical problem of the water dispenser such as plugging in the water pipe, the sanitary of the drinking water, and the cleaning problem of the water bottle.

SUMMARY OF THE PRESENT INVENTION

A main object of the present invention is to provide a water bottle cap which substantially seals at the opening of the water bottle so as to prevent any dust and dirt entering into the water bottle before the use thereof.

Another object of the present invention is to provide a water bottle cap which comprises a sealing member having a sealing edge sealed at the water passage of the cap body to prevent leakage of water from the water bottle during transportation, storage and dispensing. However, the weight of the water bottle filling with water is adapted to force the spigot adapter of the water dispenser to break the sealing edge of the sealing member.

Another object of the present invention is to provide a water bottle cap, wherein the sealing member is remained to attach to the water channel of the cap body when the spigot adapter penetrates through the water channel, so as to prevent the sealing member flowing into the water bottle.

Another object of the present invention is to provide a water bottle cap, wherein the user does not have to break the cap body to load the water bottle on the water dispenser. In other words, the cap body is remained to seal at the opening of the water bottle.

Another object of the present invention is to provide a water bottle cap, wherein a plugging guider is mounted on the sealing member to guide the spigot adapter plugging into the water channel towards the sealing edge of the sealing member so as to ensure the unsealing operation of the water bottle cap.

Another object of the present invention is to provide a water bottle cap, which is adapted to incorporate with any size of the water bottle, such as three-gallon size or five-gallon size, to be utilized for the water dispenser having the spigot adapter, so as to minimize the manufacturing and maintenance costs of the water bottle.

Accordingly, in order to accomplish the above objects, the present invention provides a water bottle cap for a water bottle having an opening and a water chamber, comprising:

a cap body comprising a sealing platform and a surrounding sealing wall extended from the sealing platform for sealedly enclosing around the opening of the water bottle, wherein the sealing wall is adapted to be unsealedly torn off for removing the cap body from the opening of the water bottle; and a water dispensing arrangement, comprising a guiding channel extended from the sealing platform of the cap body and defining a water passage for communicating the water chamber of the water bottle with outside; and a sealing member having a sealing edge integrally mounted at the guiding channel to sealedly close the water passage, wherein the sealing edge of the sealing member defines a breakable edge portion and a retaining edge portion having a thickness thicker than a thickness of the breakable edge portion of the sealing edge of the sealing member.

Therefore, when the water bottle is installed on the water dispenser, a spigot adapter of the water dispenser is plugged into the water passage to break the sealing member at the breakable edge portion thereof while the retaining edge portion of the sealing member is remained to attach to the guiding channel.

These and other objectives, features, and advantages of the present invention will become apparent from the following detailed description, the accompanying drawings, and the appended claims.

DETAILED DESCRIPTION OF THE PREFERRED EMBODIMENT

Figure 1:
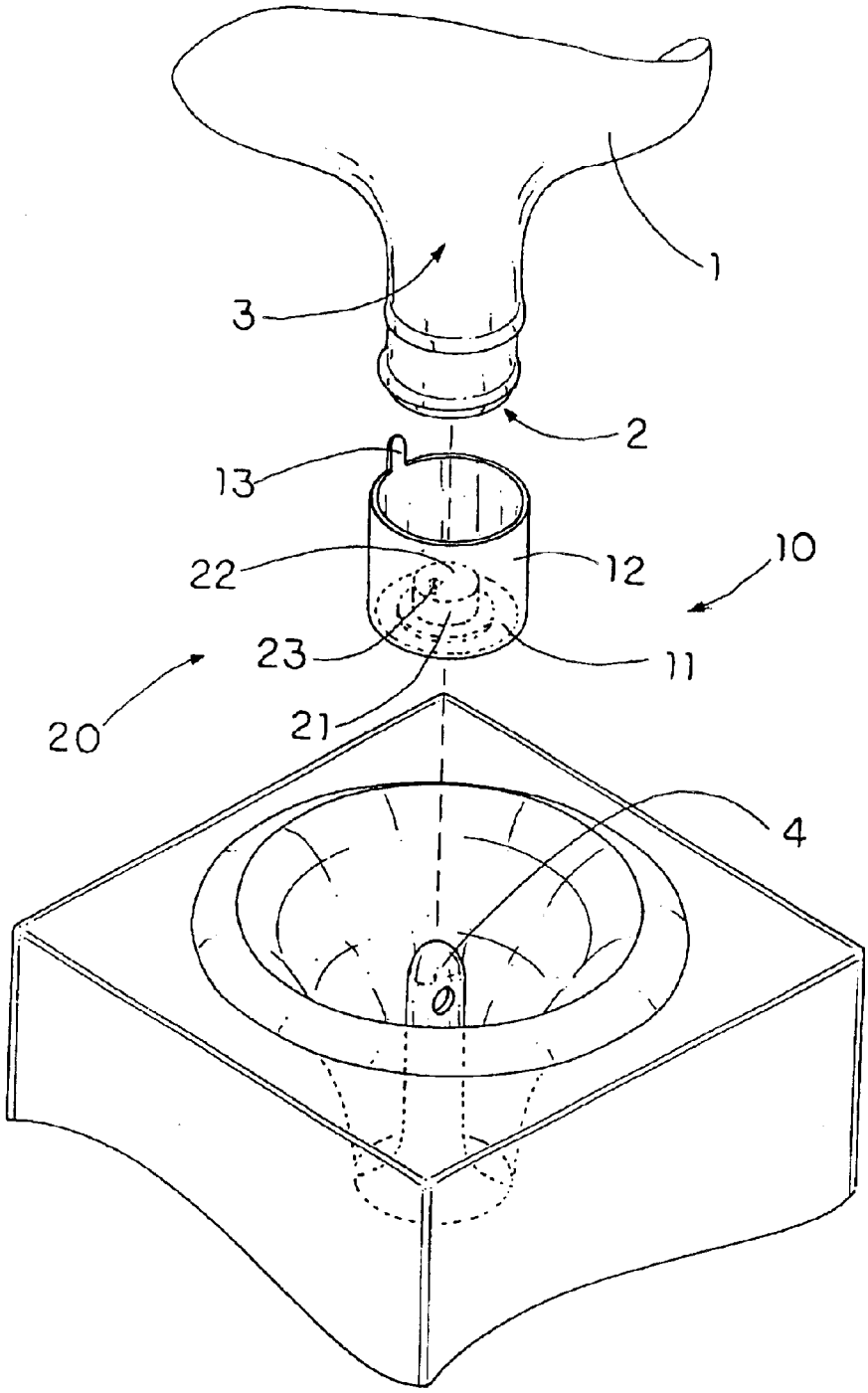
FIG. 1 is a perspective view of a water bottle cap incorporating with a water bottle according to a preferred embodiment of the present invention.
Figure 2:
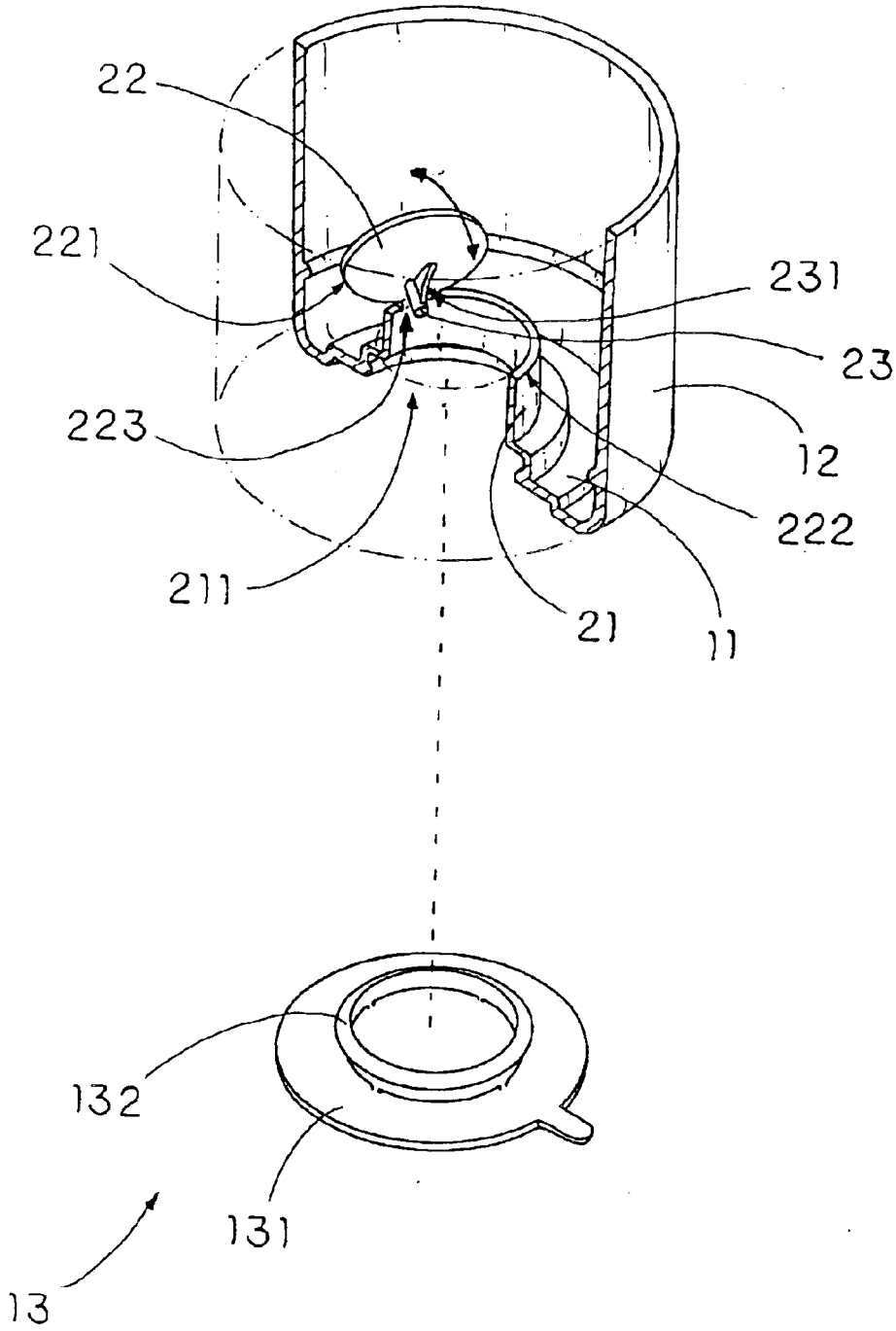
FIG. 2 is a sectional perspective view of the water bottle cap according to the above preferred embodiment of the present invention.

Referring to FIGS. 1 and 2 of the drawings, a water bottle cap according to a preferred embodiment of the present invention is illustrated, wherein the water bottle cap is adapted for incorporating with a water bottle 1 having an opening 2 and a water chamber 3.

The water bottle cap, such as a conventional bottle cap, comprises a cap body 10 comprising a sealing platform 11 and a surrounding sealing wall 12 extended from the sealing platform 11 for sealedly enclosing around the opening 2 of the water bottle 1, wherein the sealing wall 12 is adapted to be unsealedly torn off for removing the cap body 10 from the opening 2 of the water bottle 1.

The water bottle cap further comprises a water dispensing arrangement 20 comprising a hollow guiding channel 21 extended from the sealing platform 11 of the cap body 10 and defining a water passage 211 for communicating the water chamber 3 of the water bottle 1 with outside, and a sealing member 22 having a sealing edge 221 integrally mounted at the guiding channel 21 to sealedly close the water passage 211, so as to prevent leakage of water from the water bottle 1 during transportation, storage, and dispensing.

According to the preferred embodiment, the sealing wall 12 is integrally extended from the sealing platform 11 wherein the sealing platform 11 is arranged to sealedly mount on top of the opening 2 of the water bottle 1 while the sealing wall 12 is arranged to sealedly mount around a neck portion of the opening 2 of the water bottle 1. The cap body 10 further comprises a tearing lip 13 integrally extended from the sealing wall 12 in such a manner that when a tearing force is applied at the tearing lip 13, the sealing wall 12 is torn off to remove the cap body 10 from the water bottle 1.

As shown in FIG. 2, the guiding channel 21 is integrally extended from the sealing platform 11 at a position within the sealing wall 12 wherein the guiding channel 21 is arranged to guide the water in the water chamber 3 of the water bottle 1 to be dispensed to the water dispenser through the water passage 211 when the water bottle 1 is installed on the water dispenser. It is worth to mention that the size of the guiding channel 21 must be larger than a diameter of a spigot adapter 4 of the water dispenser such that the spigot adapter 4 is capable of plugging to the guiding channel 21 within the water passage 211 when the water bottle 1 is installed on the water dispenser.

Figure 3B:
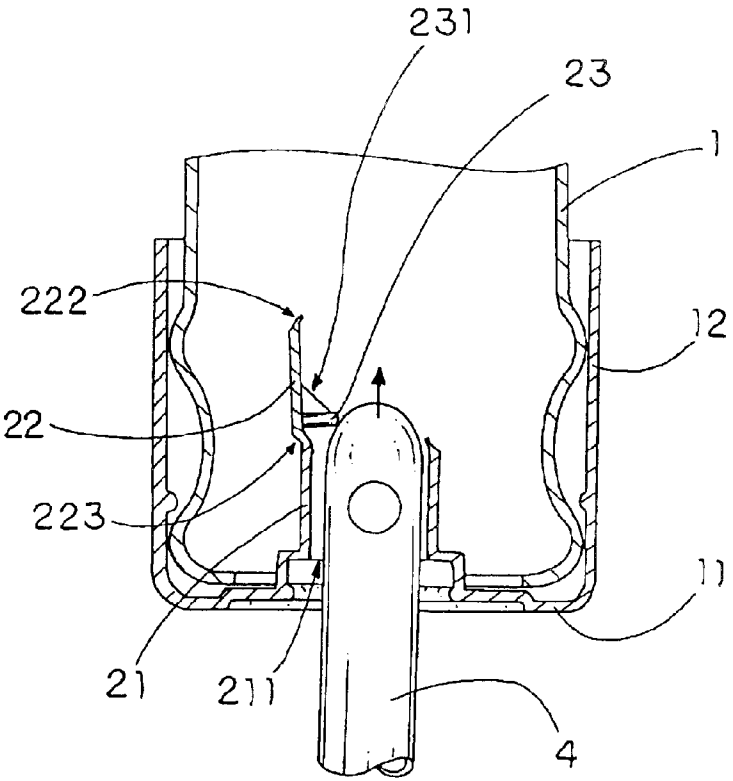
FIGS. 3A and 3B illustrate a dispensing operation of the water bottle incorporating with the water bottle cap according to the above preferred embodiment of the present invention, illustrating the plugging guider guiding the spigot adapter to break the sealing member.
Figure 3A:
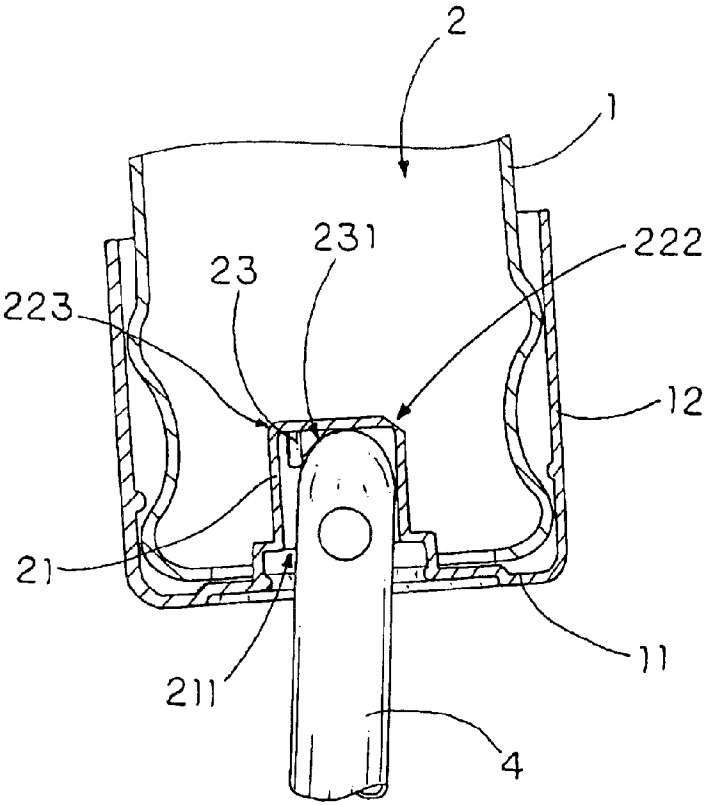

As shown in FIGS. 3A and 3B, the sealing edge 221 of the sealing member 22 is integrally extended from an inner wall of the guiding channel 21 at a bottom edge thereof to seal the water passage 211, so as to prevent the leakage of water from the water bottle 1. The sealing edge 221 of the sealing member 22 defines a breakable edge portion 222 and a retaining edge portion 223 having a thickness thicker than a thickness of the breakable edge portion 222 of the sealing edge 221 of the sealing member 22, such that the breakable edge portion 222 and the retaining edge portion 223 integrally form as the sealing edge 221 of the sealing member 22. In other words, the breakable edge portion 222 of the sealing member 22 is formed by physically reducing the thickness of a section of the sealing edge 221 such that the retaining edge portion 223 of the sealing edge 221 is thicker than the breakable edge portion 222 of the sealing edge 221.

Therefore, when the water bottle 1 is installed on the water dispenser, the spigot adapter 4 of the water dispenser is plugged into the water passage 211 to break the sealing member 22 at the breakable edge portion 222 thereof while the retaining edge portion 223 of the sealing member 22 is remained to attach to the guiding channel 21.

It is worth to mention that due to the physical properties of the sealing edge 221 of the sealing member 22, i.e. the difference of thickness between the breakable edge portion 222 and the retaining edge portion 223 of the sealing member 22, the breakable edge portion 222 of the sealing edge 221 has a tendency to be easily torn off from the guiding channel 21 when the spigot adapter 4 is plugged thereto. Thus, the retaining edge portion 223 of the sealing edge 221 is remained to attach on the guiding channel 21 so as to retain the sealing member 22 in position without entering into the water chamber 3 of the water bottle 1. Accordingly, the different thickness along the sealing edge 221 can be manufactured by injection molding techniques commonly known to those skilled in the art.

As shown in FIG. 3A, the water dispensing arrangement 20 further comprises a plugging guider 23 upwardly extended from the sealing member 22 at a position aligned with the retaining edge portion 223 thereof for guiding the spigot adapter 4 towards the breakable edge portion 222 of the sealing edge 221.

The plugging guider 23 is integrally protruded from the sealing member 22 at a position offset from a center of the sealing member 22 wherein the plugging guider 23 has a slanted guiding surface 231 extended towards the breakable edge portion 222 of the sealing edge 221 for substantially guiding the spigot adapter 4 to slide towards the breakable edge portion 222 of the sealing edge 221 along the guiding surface 231 of the plugging guider 23.

Accordingly, when the water bottle 1 is installed on the water dispenser to plug the spigot adapter 4 to the guiding channel 21, the spigot adapter 4 may point towards the center of the sealing member 22 such that the entire sealing edge 221 of the sealing member 22, which includes the breakable edge portion 222 and the retaining edge portion 223, may force to break because of the penetrating force of the spigot adapter 4. Therefore, the plugging guider 23 is capable of guiding the spigot adapter 4 to slide offset from the center of the sealing member 222 and towards the breakable edge portion 222 of the sealing member 22 along the slanted guiding surface 231, so as to ensure the penetrating force of the spigot adapter 4 offset from the retaining edge portion 223 of the sealing member 22.

As shown in FIG. 1, the cap body 10 further comprises a cap cover 13 detachably mounted on the sealing platform 11 to enclose the guiding channel 21 of the water dispensing arrangement 20. The cap cover 13 comprises a cover panel 131 sealedly mounted on the sealing platform 11 in a detachably attaching manner and a cover holder 132 downwardly extended from the cover panel 131 to slidably insert into the guiding channel 121 so as to detachably cover the cover panel 131 on the sealing platform 11.

It is worth to mention that the cap cover 13 is normally sealed on the sealing platform 11 to ensure the water contained in the water bottle 1 in a new condition and to further protect the sealing member 22 from being unsealed accidentally wherein the cap cover 13 is adapted to be unsealedly torn off from the sealing platform 11 in order to use the water bottle 1. In addition, after emptying the water in the water bottle 1, the cap cover 13 is adapted to cover on the sealing platform 11 to enclose the water chamber 3 to prevent any dust and dirt entering into the water bottle 1 so as to minimize the maintenance cost of the water bottle 1.

It is worth to mention that during transportation, storage, and dispensing, the cap body 10 is sealed at the opening 2 of the water bottle 1, such that the user does not need to break the cap body 10 for using the water bottle 10. Therefore, the cap body 10 must be torn off from the water bottle 10 when the water bottle 10 needs to be filled the water via the water supply company.

Figure 4:
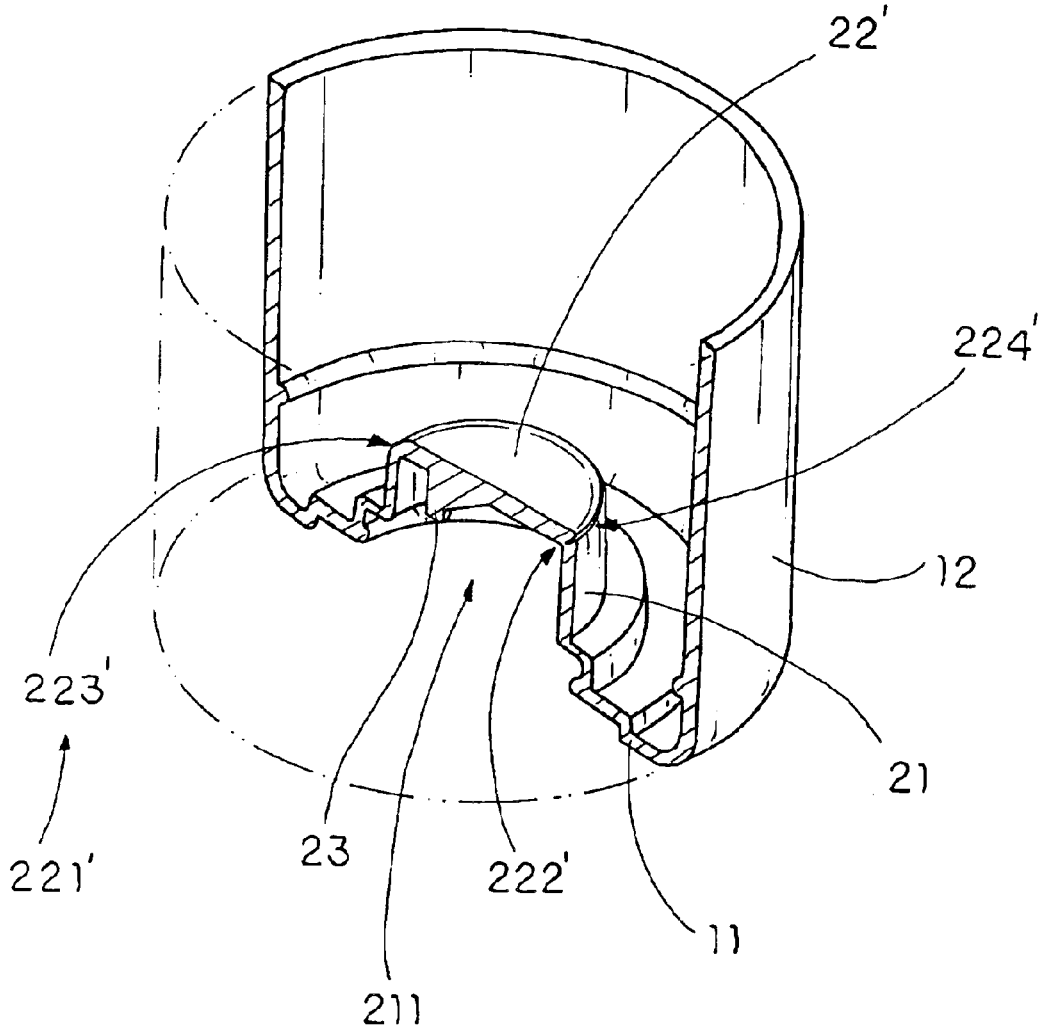
FIG. 4 illustrates an alternative mode of the sealing member of the water bottle cap according to the above preferred embodiment of the present invention.

FIG. 4 illustrates an alternative mode of the sealing member 22' wherein the sealing member 22' further has a tearing groove 224' formed along a section of the sealing edge 221' to define the breakable edge portion 222' thereof.

As it is mentioned above that the breakable edge portion 222' of the sealing member 22' is formed by physically reducing the thickness of the sealing edge 221' thereof. According to the alternative mode of the sealing member 22', the sealing edge 221' has a uniform thickness wherein the tearing groove 224' is formed on the sealing edge 221' to reduce the thickness of the portion of the sealing edge 221' so as to form the breakable edge portion 222' thereof. In other words, the retaining edge portion 223' of the sealing edge 221' is defined between two ends of the tearing groove 224' along the sealing edge 221' of the sealing member 22'.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A water bottle cap for a water bottle having an opening and a water chamber, comprising:

a cap body comprising a sealing platform and a surrounding sealing wall extended from said sealing platform for sealedly enclosing around said opening of said water bottle, wherein said sealing wall is adapted to be unsealedly torn off for removing said cap body from said opening of said water bottle; and a water dispensing arrangement, comprising a guiding channel extended from said sealing platform of said cap body and defining a water passage for communicating said water chamber of said water bottle with outside, and a sealing member having a sealing edge sealed at said guiding channel to sealedly close said water passage, wherein said sealing edge of said sealing member defines a breakable edge portion and a retaining edge portion having a thickness thicker than a thickness of said breakable edge portion of said sealing edge of said sealing member; and a plugging guider extended from said sealing member at said retaining edge portion thereof for guiding said spigot adapter to inclinedly slide towards said breakable edge portion of said sealing edge;

thereby, when said water bottle is installed on a water dispenser, said spigot adapter of said water dispenser is slid along said plugging guider to break said sealing member at said breakable edge portion thereof so as to plug into said water passage while said retaining edge portion of said sealing member is remained to attach to said guiding channel.

2. The water bottle cap, as recited in claim 1, wherein said plugging guider as a slanted guiding surface extended towards said breakable edge portion of said sealing edge for substantially guiding said spigot adapter to inclinedly slide towards aid breakable edge portion of said sealing edge along said guiding surface of said lugging guider.

3. The water bottle cap, as recited in claim 1, wherein said plugging guide is integrally protruded from said sealing member at a position offset from a center of said sealing member to align with said breakable edge portion of said sealing edge.

4. The water bottle cap, as recited in claim 2, wherein said plugging guide is integrally protruded from said sealing member at a position offset from a center o said sealing member to align with said breakable edge portion of said sealing edge.

5. The water bottle cap, as recited in claim 1, wherein said breakable edge portion of said sealing member is formed by physically reducing said thickness of a section of said sealing edge such that said retaining edge portion of said sealing edge is thicker than said breakable edge portion of said sealing edge.

6. The water bottle cap, as recited in claim 2, wherein said breakable edge portion of said sealing member is formed by physically reducing said thickness of a section of said sealing edge such that said retaining edge portion of said sealing edge is thicker than said breakable edge portion of said sealing edge.

7. The water bottle cap, as recited in claim 4, wherein said breakable edge portion of said sealing member is formed by physically reducing said thickness of a section of said sealing edge such that said retaining edge portion of said sealing edge is thicker than said breakable edge portion of said sealing edge.

8. The water bottle cap, as recited in claim 1, wherein said sealing member further has a tearing groove formed along a section of said sealing edge to define s id breakable edge portion thereof, such that said retaining edge portion of said sealing edge is thicker than said breakable edge portion of said sealing edge.

9. The water bottle cap, as recited in claim 2, wherein said sealing member further has a tearing groove formed along a section of said sealing edge to define said breakable edge portion thereof, such that said retaining edge portion of said sealing edge is thicker than said breakable edge portion of said sealing edge.

10. The water bottle cap, as recited in claim 4, wherein said sealing member further has a tearing groove formed along a section of said sealing edge to define aid breakable edge portion thereof, such that said retaining edge portion of said sealing edge is thicker than said breakable edge portion of said sealing edge.

11. The water bottle cap, as recited in claim 1, wherein said sealing edge of said sealing member is integrally extended from an inner wall of said guiding channel at a bottom edge thereof to seal said water passage.

12. The water bottle cap, as recited in claim 7, wherein said sealing edge of said sealing member is integrally extended from an inner wall of said guiding channel at a bottom edge thereof to seal said water passage.

13. The water bottle cap, as recited in claim 10, wherein said sealing edge of said sealing member is integrally extended from an inner wall of said guiding channel at a bottom edge thereof to seal said water passage.

14. The water bottle cap, as recited in claim 1, wherein said cap body further comprises a cap cover detachably mounted on said sealing platform to enclose said guiding channel so as to protect said sealing member from being unsealed accidentally.

15. The water bottle cap, as recited in claim 11, wherein said cap body further comprises a cap cover detachably mounted on said sealing platform to enclose said guiding channel so as to protect said sealing member from being unsealed accidentally.

16. The water bottle cap, as recited in claim 12, wherein said cap body further comprises a cap cover detachably mounted on said sealing platform to enclose said guiding channel so as to protect said sealing member from being unsealed accidentally.

17. The water bottle cap, as recited in claim 13, wherein said cap body further comprises a cap cover detachably mounted on said sealing platform to enclose said guiding channel so as to protect said sealing member from being unsealed accidentally.

18. The water bottle cap, as recited in claim 14, wherein said cap cover comprises a cover panel sealedly mounted on said sealing platform in a detachably attaching manner and a cover holder downwardly extended from said cover panel to slidably insert into said guiding channel so as to detachably cover said cover panel on said sealing platform.

19. The water bottle cap, as recited in claim 16, wherein said cap cover comprises a cover panel sealedly mounted on said sealing platform in a detachably attaching manner and a cover holder downwardly extended from said cover panel to slidably insert into said guiding channel so as to detachably cover said cover panel on said sealing platform.

20. The water bottle cap, as recited in claim 17, wherein said cap cover comprises a cover panel sealedly mounted on said sealing platform in a detachably attaching manner and a cover holder downwardly extended from said cover panel to slidably insert into said guiding channel so as to detachably cover said cover panel on said sealing platform.

* * * * *